United States Patent [19]

Morii et al.

[11] Patent Number: 5,056,583

[45] Date of Patent: Oct. 15, 1991

[54] CONTINUOUSLY AND CONCURRENTLY CASTING DIFFERENT ALLOYS

[75] Inventors: Kiyoshi Morii, Kohnan; Shuzo Kumura, Aichi; Shyzunori Hayakawa, Tokai; Yoshio Inagaki, Aichi, all of Japan

[73] Assignee: Daido Tokushuko Kabushiki Kaisha, Nagaya, Japan

[21] Appl. No.: 568,123

[22] Filed: Aug. 16, 1990

[30] Foreign Application Priority Data

Aug. 17, 1989 [JP] Japan ..... 1-211857

[51] Int. Cl.[5] ..... B22D 11/10; B22D 11/18

[52] U.S. Cl. ..... 164/453; 164/420; 164/459; 164/488

[58] Field of Search ..... 164/459, 453, 420, 488

[56] References Cited

U.S. PATENT DOCUMENTS

| | | | |
|---|---|---|---|
| 2,948,030 | 8/1960 | Easton | 164/420 |
| 3,344,847 | 10/1967 | Beemer | 164/420 |
| 4,632,173 | 12/1986 | Kaneko et al. | 164/420 X |

FOREIGN PATENT DOCUMENTS

| | | | |
|---|---|---|---|
| 2453696 | 12/1980 | France | 164/420 |
| 58-50160 | 3/1983 | Japan | 164/420 |
| 58-168464 | 10/1983 | Japan | 164/459 |
| 61-147953 | 7/1986 | Japan | 164/420 |
| 61-189848 | 8/1986 | Japan | 164/459 |
| 64-11057 | 1/1989 | Japan | 164/420 |

*Primary Examiner*—J. Reed Batten, Jr.

*Attorney, Agent, or Firm*—Varndell Legal Group

[57] ABSTRACT

The continuous casting method uses a multistrand type continuous casting apparatus having a plurality of tundishes each provided with a plurality of nozzles for casting strands of at least two different alloys where at least one alloy is cast into two or more strands. The method transfers molten metal into the tundishes from separate ladles corresponding to each tundish, and one tundish feeds at least two water-cooled molds through the nozzles for continuous casting thereof. The number of strands cast for each of the different alloys is determined based on the time required for the preparation of each molten metal, an amount of charge and a casting speed of each molten metal, so as to improve the yield of expensive alloys and/or enhance the rate of operation of the apparatus.

9 Claims, 6 Drawing Sheets

CONTINUOUSLY AND CONCURRENTLY CASTING DIFFERENT ALLOYS

BACKGROUND OF THE INVENTION

1. Field of the Invention

This invention relates to an improved apparatus for continuously casting metals and, in particular, special steels.

2. State of the Art

In the manufacture of special steels, as well as that of ordinary steels, a molten steel can be cast by continuous casting into cast pieces in the majority of cases. Due to the fact that the cast pieces can be readily separated, continuous casting is advantageous for providing a high yield of a rolled steel product. Namely, the cast portions of a steel strand which are obtained continuously can be cut off at their respective longitudinal end portions. Accordingly, when casting steels of different kind, it is advantageous that each strand is cast as close as possible to the next strand. This is called continuous-continuous casting.

A continuous casting apparatus for a multistrand system which is used industrially employs a water-cooled mold for providing a plurality of strands of casting material. In this apparatus, a molton steel is transferred from a ladle to a tundish and cast concurrently by the water-cooled mold. This apparatus provides enhanced continuous casting, because the duration of time for casting of each ladle can be shortened, and because problems due to temperature drop of the molten metal can be minimized. With this apparatus the number of strands cast varies according to factors such as type of steel, strand sectional size, drawing speed and so forth. This system normally can cast 2 to 8 strands, however, a typical apparatus will cast 4 strands.

The kinds of steel kind for mass production by such multistrand system continuous casting apparatus are preferably those which can take advantage of the continuous casting. For example, a molton steel in a 80-ton ladle can be cast in 4 charges on a 4-strand apparatus. However, special steel or specialty steels are usually cast in a small-lot, and a molten steel of 80 tons can be cast in only one charge. In this situation a deterioration in yield is unavoidable when casting on the 4-strand apparatus. This is due in part to the fact that small lot of a special steel generally contains a significant amount of an expensive alloying component, making it is desirable to obtain a high yield based upon the requirements of saving resources, as well as saving energy and decreasing costs.

On the other hand, a continuous casting apparatus requires a great deal of investment in equipment and, therefore, it is preferable that such an apparatus be used at a high rate of operation even when casting special steel.

Recent large-scale steel foundries employ various types of smelting apparatuses, such as a convertor, an arc furnace, an AOD furnace, a LF furnace and the like, based on the kind of steel to be manufactured. These apparatuses are generally used for preparing more than one kind of steel. Under such circumstances, it is desirable that the foundries be operated to harmonize the yield of steel with a rate of operation for all kinds of steels, including special steels.

SUMMARY OF THE INVENTION

An object of the present invention is to provide a method and an apparatus for multistrand continuous casting of steels where cast pieces can be concurrently manufactured by casting strands of at least two alloys of different composition, for example, stainless steel and general steel, by using four casting strands and respectively casting the at least two different alloys into 2 strands+2 strands or 3 strand+1 strand, so as to optimize steel production. The same method and apparatus can also be used for casting four stands collectively.

As mentioned above, one aspect of the present invention is to provide a continuous casting method capable of concurrently casting alloys of at least two different compositions. The present method can use a multistrand type continuous casting apparatus including a plurality of water-cooled molds arrayed thereon, and a plurality of tundishes each provided with a number of nozzles for dividing the number of strands into two or more strands at a predetermined ratio. In the present method, molten metal is transferred into the tundishes from separate ladles corresponding to each tundish, and the molten metal is fed to each water-cooled mold through the nozzles of the tundishes for continuous casting. An important aspect of the present is selecting and dividing the number of casting strands resulting from the method in a manner which improves yield of expensive alloys and enhances rate of operation of the apparatus. The selecting and dividing of the casting strands can be based on a time cycle required for the preparation of each molten metal, an amount of charge of each molten metal and casting speed of each molten metal.

Another aspect of the present invention is providing continuous casting apparatus for practicing the aforementioned method, which is capable of continuously casting alloys of two or more different composition concurrently. The apparatus of the present invention can be a multistrand type continuous casting apparatus which can comprise two or more tundishes each supported on tundish support means, a plurality of water-cooled molds arrayed below the tundishes, and molten metal ladles on ladle support means correspondingly to each tundish. The plurality of water-cooled molds are arranged so that two or more of the molds can receive molten metal from one of the two or more tundishes by, for example, an arrangement of a row of the water-cooled molds in which the individual water-cooled molds can be moved to be in close proximity of each other or spaced from each other. The ladle support means can comprise traveling cranes, girders and transfer trucks. The girders are arranged in the direction transverse to the row of the water-cooled molds. The transfer truck slide on the girders, so as to have reciprocating movement transverse to the row of the water-cooled molds. The transfer trucks can received and hold the ladles thereon.

BRIEF DESCRIPTION OF THE DRAWINGS

FIG. 2 is a schematic plan view of the apparatus of the present invention.

FIG. 3 is a side view in the direction indicated by an arrow "1" in FIG. 2.

FIG. 4 is a side view in the direction indicated by an arrow "2" in FIG. 2.

FIG. 5 and FIG. 6 are side views similar to FIG. 4, indicating various ladle changing systems.

FIG. 7 and FIG. 8 are respectively a plan view and a side view showing a tundish and its support means, respectively.

DETAILED EXPLANATION OF PREFERRED EMBODIMENTS

In the manufacture and continuous casting of a special steel by an arc furnace, the time required for smelting is generally 80 minutes or so. This time for smelting is representative and the actual time for smelting can vary according to the kind of steel smelted. The word "smelting" in the present application refers to the mixing or fusing of the elements making up the various kinds of steels. The continuous casting speed for the special steel is independent of smelting time and can vary greatly based on a desired quality. Accordingly, when casting steels or metals for which segregation or division casting is not desirable, such as bearing steel, the casting speed of the such steel must be controlled to half of the casting speed of ordinary steel and stainless steel.

The present invention can be exemplified by considering a situation where a continuous casting is carried out by melting and casting an ordinary steel "A" in 3 charges; an ordinary steel "B" in 4 charges; a stainless steel SUS in 4 charges; and a bearing steel "C" firstly in 1 charge on 2 arc furnaces of appropriate capacity and, secondly, in a 4-strand type continuous casting apparatus. The casting is carried out under the condition that the ordinary steel (A & B) and the stainless steel (SUS) generally have a drawing speed which can be increased, so that 1 charge of molten steel can be processed through continuous casting in half of the time required for smelting. However, the bearing steel (C) has a drawing speed which must be retarded because the time for casting is as long as that of smelting. Thus, when continuous casting the bearing steel (C) in, i.e., 4 strands, the casting time is double that of the ordinary steel (A & B) and stainless steel (SUS).

In view of the circumstances that the stainless steel (SUS) may exert an influence on the next charge with remaining molten steel in the arc furance due to its high nickel and chromium contents, and that an exclusive ancillary equipment is required for the arc furnace because the differences in melting processes of stainless steel and ordinary steel; the melting of the stainless steel must be limited to a specified one of the two arc furnaces. On the other hand, from the viewpoint of continuous casting, it is desirable that the same kind of steel be cast jointedly in succession, so as to avoid the need to cut the strand after each successive charge.

Figure 1:
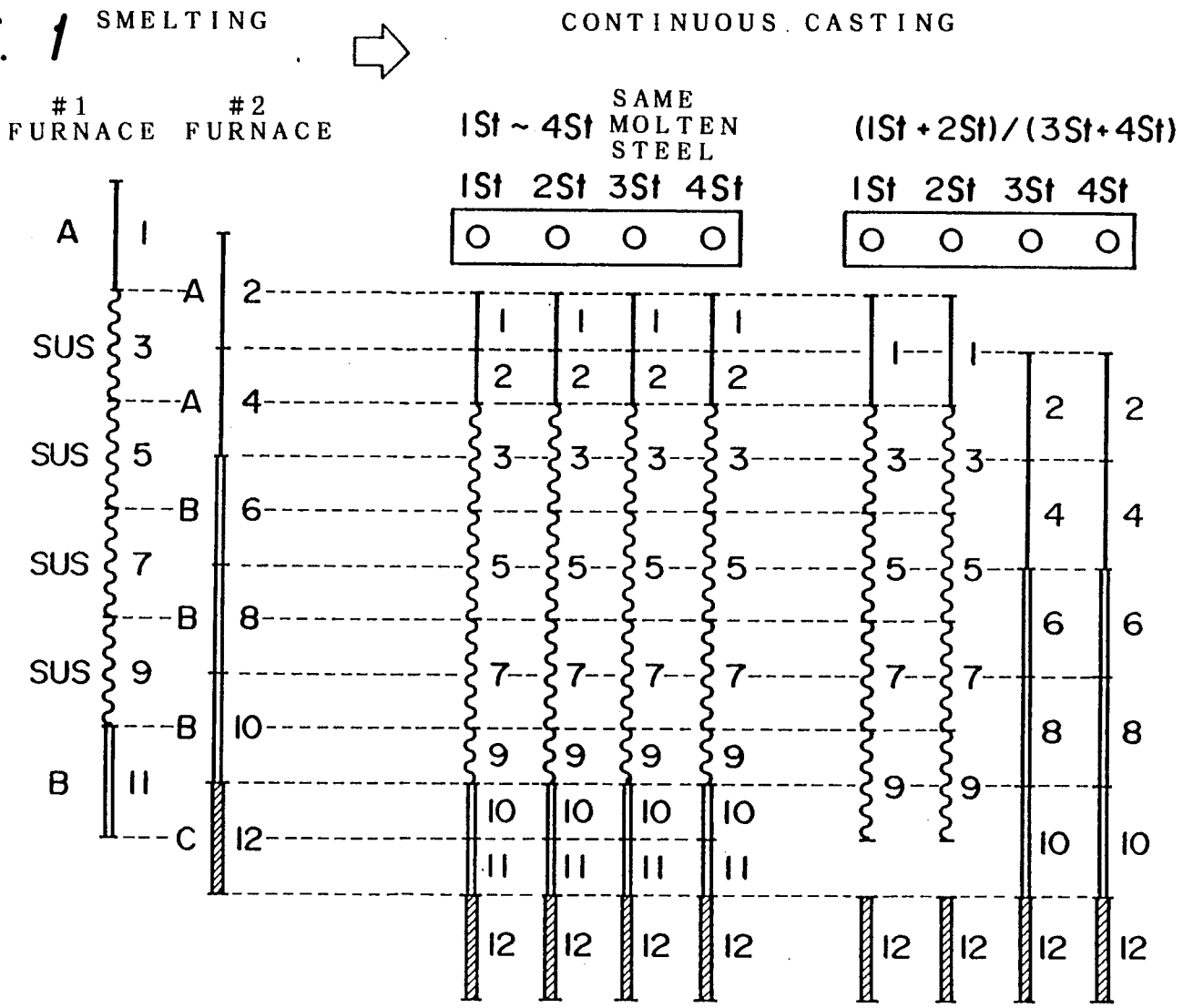
FIG. 1 is a conceptional explanatory drawing exemplifying a continuous casting pattern according to a method of this invention in relation to smelting.

FIG. 1 shows, in comparison, sequences of the case where the same molten steel is cast into 4 strands (middle portion); and the case where two different molten steels are respective cast by 2 strands and 2 strands (1St+2St/3St+4St) under the condition given above (far right portion of FIG. 1), according to the present invention.

As will be apparent from FIG. 1, a time half of that of smelting is sufficient for casting an ordinary steel (A & B) in 4 strands. However, when charges of stainless steel are cast jointedly in succession, the casting speed must be decreased so as to be in harmony with the efficiency of the one of the two arc furnaces, namely, the casting time is as long as the smelting time. Thus, in the system of casting the same molten steel into 4 strands as shown in the middle portion of FIG. 1, three charges (charges 4, 6, 8) of the ordinary steels "A" and "B" melted in the furnace #2 cannot be continuous cast in such a system.

On the other hand, when subjecting two strands each to a continuous casting as (1St+2St) for the stainless steel and (3St+4St) for the ordinary steel according to the present invention as shown in the far right portion of FIG. 1, one charge (11) must be removed from the continuous casting while an adjustment is made for starting the concurrent casting of the four strands the bearing steel (C) when casting in four strands is desired. However, when compared to the case where the same molten steel is subjected to a continuous casting in four strands charges, 4, 6 and 8 can be cast, as shown in the far right portion of FIG. 1. Thus, in this case, two additional two charges can be cast. This increase in the number of charges which can be cast in the present invention and the corresponding increase in productivity of the present invention will increase as the ratio of the stainless steel cast is increased.

The description given above exemplifies only one case, and when using different casting speeds and furnace capacities, an optimal pattern for melting and continuous casting can be determined by practicing this invention based on the above description.

Figure 2:
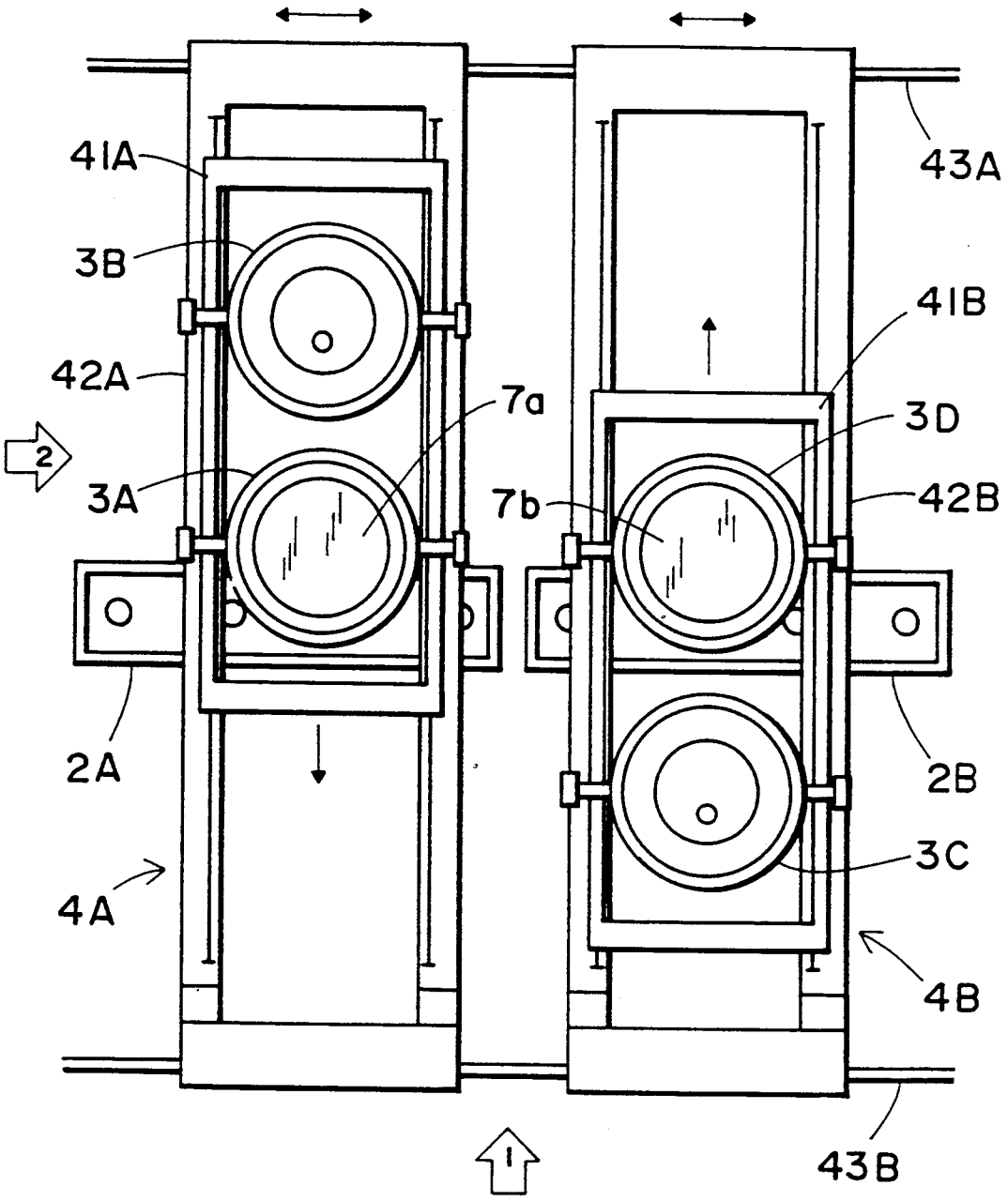
FIG. 2 to FIG. 8 are drawings representing a structure of a continuous casting apparatus of this invention.
Figure 3:
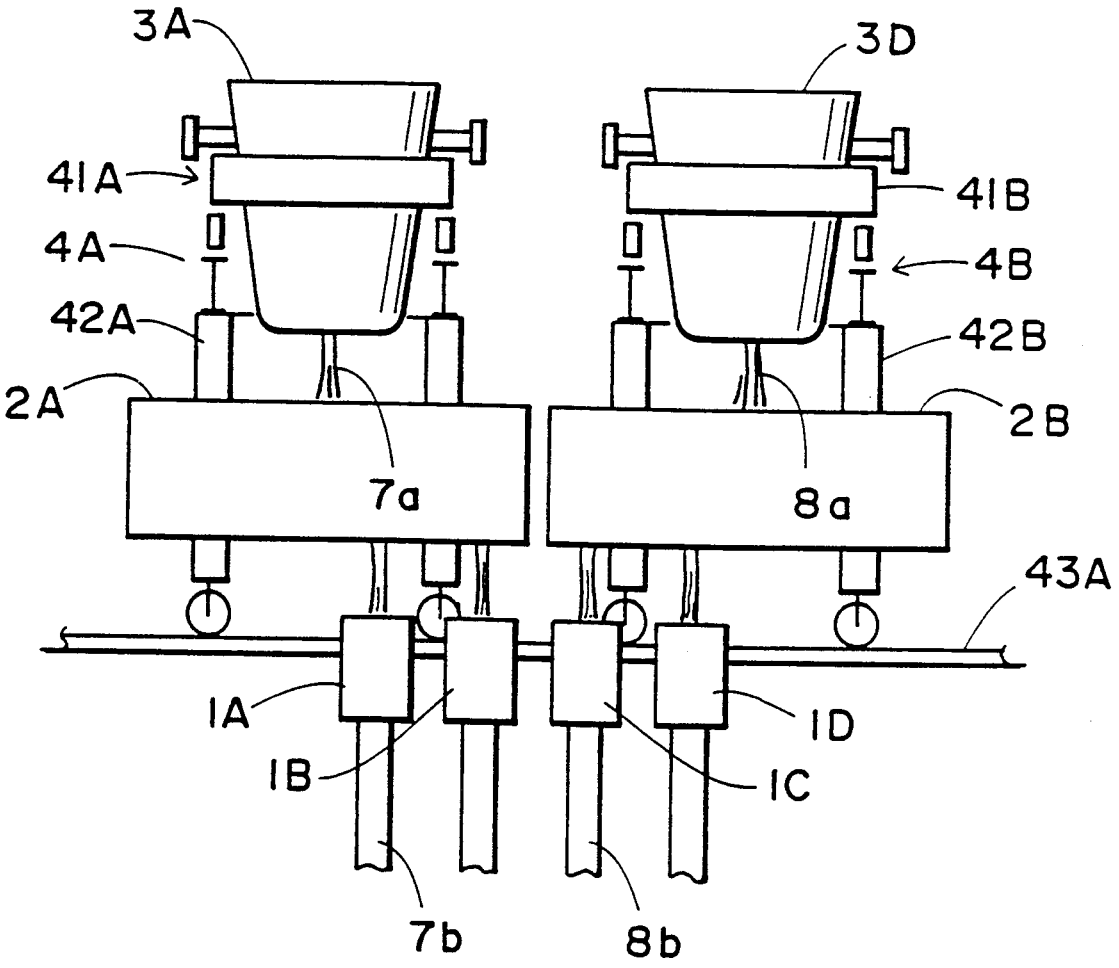

FIG. 2 and FIG. 3 illustrate a continuous casting apparatus capable of practicing the method of this invention. As shown, two tundishes (2A, 2B) can be disposed on a row above four water-cooled molds (1A, 1B, 1C, 1D), so as to share the water-cooled molds (2 water-cooled molds each as illustrated). Molten metals are fed from the molten metal ladles correspondingly to each tundish. For example, ladles 3A and 3B feed molten metal to the tundish 2A, and ladles 3C and 3D feed molten metal to tundish 2B. In the example illustrated, different molten metals (*7a* and *7b*) are respectively fed from a ladle (3A) to the tundish (2A) and from another ladle (3D) to the tundish (2B), the molten metal *7a* is subjected to a continuous casting through the water-cooled molds (1A and 1B) and the molten metal *7b* is subjected to continuous casting through the water-cooled molds (1C and 1D), thereby obtaining 4 strands (*7a*×2 pcs., *7b*×2 pcs.).

Figure 4:
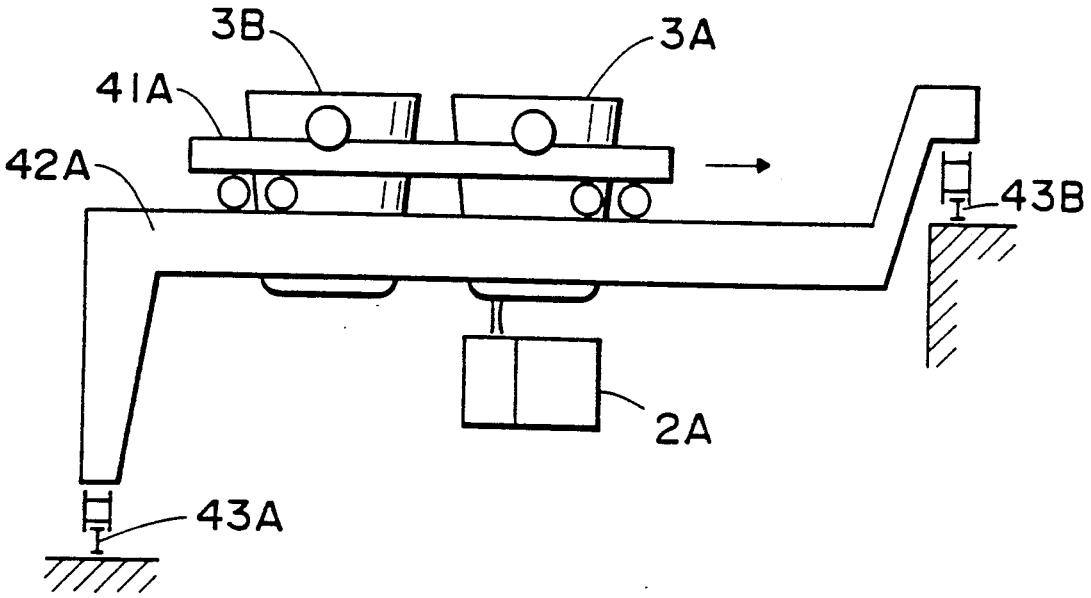

Ladle support means (4A, 4B), as illustrated in FIG. 4, includes transfer trucks (41A, 41B) and traveling cranes (42A, 42B), and is capable of, for example, changing the ladles for molten metals fed to the tundish (2A) from (3A) to (3B) by movement of the transfer truck (41A), and carrying an emptied ladle away from over the tundish (2A). As shown in FIG. 2, the ladle support means can also move to carrying over another ladle from the other crane 42B containing a molten metal by movement of the traveling cranes (41A & 42A) on rails (43A, 43B). An overhead crane (not illustrated) can be used for supplying or removing ladles, etc., as shown in FIG. 5.

Figure 5:
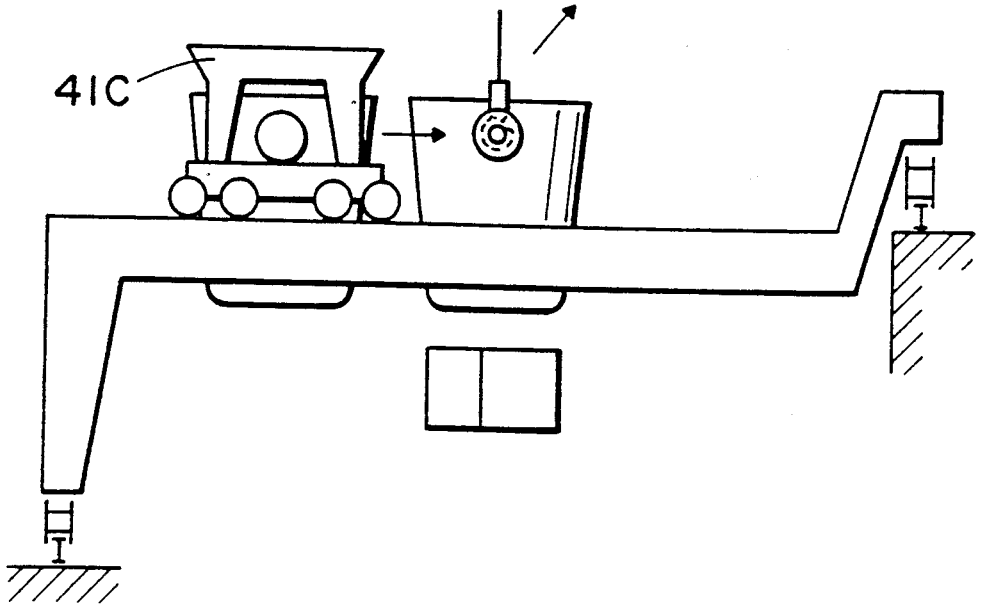
Figure 6:
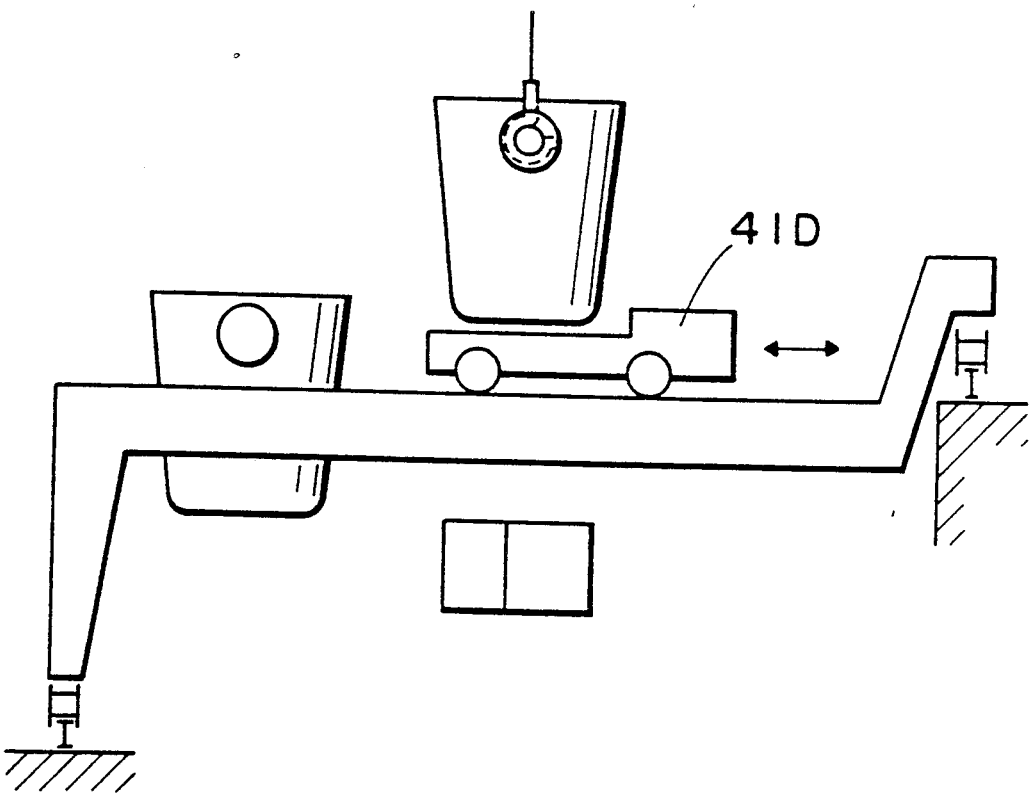

Changing of the ladle which supply molten metal to a tundish can be effectd by the two-throw transfer trucks (41A, 41B) as shown in FIG. 2 and FIG. 4, together with various modes, as shown, for example, in FIG. 5 and FIG. 6. That is, the ladle is ready for changing through a combination of use of transfer trucks (41C of FIG. 5 and 41D of FIG. 6) which support only one ladle, together with the overhead crane.

Figure 7:
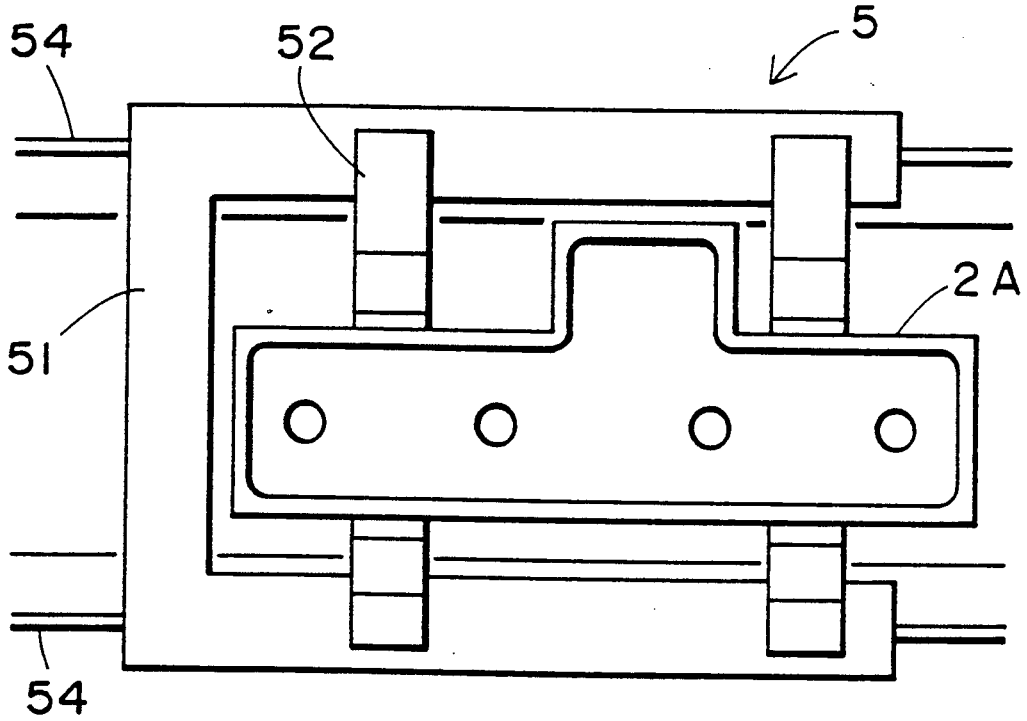
Figure 8:
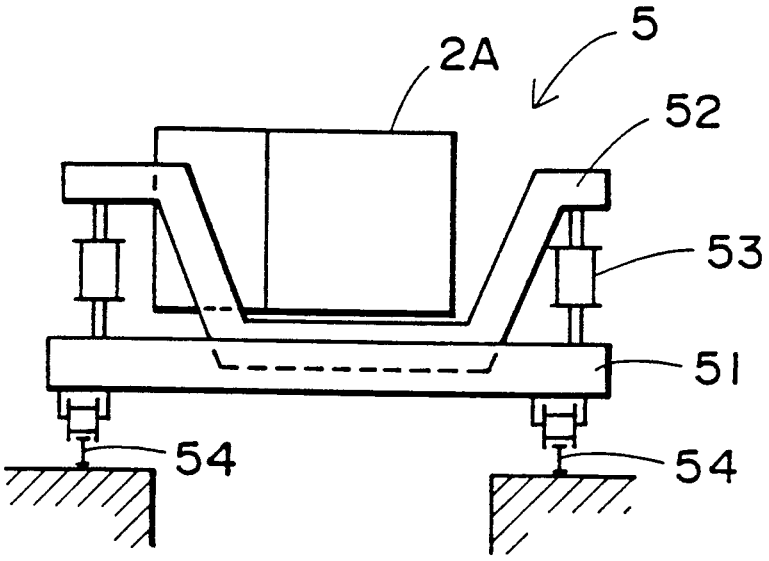

The tundish may be supported on support means (5) shown in FIG. 7 and FIG. 8. The support means (5) is structured such that a support arm (52) on a truck (51) can be finely adjusted for height by means, such as hydraulic cylinder (53) or the like. By moving on a rail (54), the truck (51) is capable of changing the number or which water-cooled molds are shared by a particular tundish. For example, when 4 water-cooled molds are used, the tundish can be moved to share 1, 2, 3 or 4 water-cooled molds, namely (3 pcs.+1 pc.) or (4 pcs.+0 pcs.) from (2 pcs.+2 pcs.) with reference to casting 4 strands.

When carrying out a continuous casting according to the method of this invention, the number of casting strands can be divided at a predetermined ratio based upon the kinds of steel cast, and various metals may be cast concurrently in succession on a multistrand type continuous casting apparatus.

The present invention is especially adapted for securing a high yield when casting a special steel containing expensive alloy components, and provides a continuous casting apparatus, which requires a large amount of equipment investment, with a high rate of operation efficiency.

As an apparatus for carrying out the aforementioned continuous casting, the apparatus according to this invention may be realized by modifying an existing multistrand type continuous casting equipment, or a design may be accomplished without adding a radical modification to that of existing design, and hence the equipment can be constructed without a great difference in cost from that of conventional equipment.

We claim:

1. A method for casting alloys of different compositions comprising:

supplying at least a first molten metal and a second molten metal to a plurality of ladles, said first and second molten metals having different compositions, feeding said first molten metal to a first tundish and said second molten metal to a second tundish, continuously and concurrently casting said first and second molten metals through four water-cooled molds by feeding said first molten metal from said first tundish to at least two of said four water-cooled molds and feeding said second molten metal from said second tundish to at least one of said four water-cooled molds.

2. The method according to claim 1, wherein a number of said water-cooled molds respectively fed by said first and second tundishes is selected based upon time required for preparing said first and second molten metals, an amount of said first and second molten metals supplied to said ladles, and casting speed of said first and second molten metals for increasing yield of said method.

3. The method according to claim 1, wherein said first molten metal is an expensive alloy.

4. The method according to claim 1, wherein said first molten metal is stainless steel.

5. The method according to claim 1, further comprising supplying a third molten metal having a composition different from said first and second molten metals to said plurality of ladles; feeding said third molten metal to one of said first and second tundishes after said first and second molten metals, and continuously casting said third molten metal through at least one of said four water-cooled molds while one of said first and second molten metals is continuously and concurrently cast through a remaining number of said four water-cooled molds.

6. A method for casting alloys of different compositions comprising:

supplying at least a first, second and third molten metal to a plurality of ladles, said first, second and third molten metals having different compositions, feeding said first molten metal to a first and second tundish, continuously and concurrently casting said first molten metal through four water-cooled molds by feeding said first molten metal from said first tundish to at least two of said four water-cooled molds.

feeding said second molten metal to said first tundish, continuously casting said second molten metal by feeding said second molten metal from said first tundish to at least two of said four water-cooled molds while concurrently and continuously casting said first molten metal by feeding said first molten metal from said second tundish to at least one of said four water cooled molds.

supplying said third molten metal to said second tundish, continuously casting said third molten metal by feeding said third molten metal from said second tundish to at least one of said four water-cooled molds while concurrently casting said second molten metal by feeding said second molten metal from said first tundish to at least two of said four water-cooled molds.

7. A method according to claim 6, wherein the number of said water-cooled molds respectfully fed by said first and second tundishes is selected based upon the time required for preparing said first, second and third molten metals; amounts of said first, second and third molten metals supplied to said ladles; and casting speed of said first, second and third molten metals for increasing yield of said method.

8. The method according to claim 7, wherein a first charge of said first molten metal is initially fed to said first tundish and then second and third charges of said first molten metal are fed to said second tundish, four charges of said second molten metal are fed to said first tundish sequentially after said first charge of said first molten metal is continuously cast, and three charges of said third molten metal are fed to said second tundish sequentially after said third charge of said first molten metal is continuously cast.

9. The method according to claim 8, wherein after continuous casting of said second and third molten metal, a fourth molten metal is fed to said first and second tundishes and sequentially continuously cast from said second tundish after continuous casting of said second molten metal is complete.

* * * * *